US010648290B2

(12) United States Patent
Fears et al.

(10) Patent No.: US 10,648,290 B2
(45) Date of Patent: May 12, 2020

(54) SLEEVE SHIFTING TOOL

(71) Applicant: Thru Tubing Solutions, Inc., Oklahoma City, OK (US)

(72) Inventors: Brett Fears, Mustang, OK (US); Brock Watson, Oklahoma City, OK (US)

(73) Assignee: Thru Tubing Solutions, Inc., Oklahoma City, OK (US)

( * ) Notice: Subject to any disclaimer, the term of this patent is extended or adjusted under 35 U.S.C. 154(b) by 268 days.

(21) Appl. No.: 15/024,656

(22) PCT Filed: May 18, 2015

(86) PCT No.: PCT/US2015/031329

§ 371 (c)(1),
(2) Date: Mar. 24, 2016

(87) PCT Pub. No.: WO2015/179271

PCT Pub. Date: Nov. 26, 2015

(65) Prior Publication Data

US 2016/0208581 A1 Jul. 21, 2016

Related U.S. Application Data

(60) Provisional application No. 61/994,941, filed on May 18, 2014.

(51) Int. Cl.
*E21B 41/00* (2006.01)
*E21B 23/02* (2006.01)

(52) U.S. Cl.
CPC ..... *E21B 41/00* (2013.01); *E21B 23/02* (2013.01)

(58) Field of Classification Search
CPC .... E21B 41/00; E21B 23/04; E21B 2034/007; E21B 34/14; E21B 23/06; E21B 23/02
See application file for complete search history.

(56) References Cited

U.S. PATENT DOCUMENTS 2,698,056 A * 12/1954 Marshall ..... E21B 23/02 166/123
3,701,389 A * 10/1972 Egnelov ..... E21B 25/02 175/246

(Continued)

FOREIGN PATENT DOCUMENTS

WO 2012091838 A2 7/2012

OTHER PUBLICATIONS

PCT/US2015/031329; International Search Report and Written Opinion; dated Aug. 21, 2015; 18 pages.

*Primary Examiner* — Cathleen R Hutchins
*Assistant Examiner* — Jonathan Malikasim
(74) *Attorney, Agent, or Firm* — Hall Estill Law Firm

(57) ABSTRACT

A sleeve shifting tool for shifting a slidable sleeve positioned inside of another downhole tool is described herein. The tool has a housing and a collet apparatus for engaging a slidable sleeve disposed within a downhole tool positioned in a wellbore. The collet apparatus includes at least one collet arm and at least one collet key disposed thereon for engaging the slidable sleeve. The tool also includes a collet activation apparatus for initiating the collet apparatus and force the at least one collet key of the collet apparatus to engage the slidable sleeve. A method of shifting a sleeve positioned in a downhole tool with the sleeve shifting tool described herein is also provided herein.

25 Claims, 5 Drawing Sheets

(56) References Cited

U.S. PATENT DOCUMENTS

| | | | | | |
|---|---|---|---|---|---|
| 3,856,081 | A * | 12/1974 | Canalizo | E21B 23/02 | 166/123 |
| 3,955,624 | A * | 5/1976 | Fredd | E21B 31/20 | 166/72 |
| 4,266,614 | A | 5/1981 | Fredd | | |
| 5,549,161 | A | 8/1996 | Gomez et al. | | |
| 5,641,023 | A | 6/1997 | Ross et al. | | |
| 6,095,583 | A * | 8/2000 | Beeman | E21B 31/20 | 294/86.15 |
| 7,219,743 | B2 * | 5/2007 | Wolters | E21B 34/101 | 166/105 |
| 7,665,528 | B2 * | 2/2010 | Ross | E21B 34/103 | 166/317 |
| 9,771,762 | B2 * | 9/2017 | Baudoin | E21B 17/06 | |
| 2011/0226489 | A1 | 9/2011 | Hofman et al. | | |

* cited by examiner

SLEEVE SHIFTING TOOL

CROSS-REFERENCE TO RELATED APPLICATIONS

The present application is a national stage application of a PCT application having International Application No. PCT/US2015/031329, filed May 18, 2015, which claims priority to U.S. Provisional Application having U.S. Ser. No. 61/994,941, filed May 18, 2014, which claims the benefit under 35 U.S.C. 119(e). The disclosure of which is hereby expressly incorporated herein by reference.

BACKGROUND OF THE DISCLOSURE

Field of the Invention

The present disclosure relates to a tool that can be run past restrictions and inside of another downhole tool that includes a shiftable sleeve.

Description of the Related Art

Traditionally, a sleeve shifting tool can have collets (or lugs) that are forced out of the tool and are very rigid and non-flexible. The rigidity and inflexibility of the collets damages the collets and makes them unusable. Accordingly, there is a need for a sleeve shifting tool designed such that the collets (or lugs) are able to withstand the wear and tear encountered by the collets during use of the sleeve shifting tool.

SUMMARY OF THE DISCLOSURE

This disclosure relates to a sleeve shifting tool for shifting a slidable sleeve positioned inside of another downhole tool. The tool having a housing and a collet apparatus for engaging a slidable sleeve disposed within a downhole tool positioned in a wellbore. The collet apparatus includes at least one collet arm and at least one collet key disposed thereon for engaging the slidable sleeve. The tool also includes a collet activation apparatus for initiating the collet apparatus and force the at least one collet key of the collet apparatus to engage the slidable sleeve.

The disclosure is also directed toward a method of shifting a sleeve positioned in a downhole tool. The sleeve shifting tool described herein is positioned within the downhole tool that includes the sleeve disposed therein. The sleeve shifting tool can then engage the sleeve disposed in the downhole tool. Once the sleeve shifting tool is engaged with the sleeve in the downhole tool, the sleeve is shifted in the uphole or downhole direction via the sleeve shifting tool.

DETAILED DESCRIPTION OF THE DISCLOSURE

Figure 7:
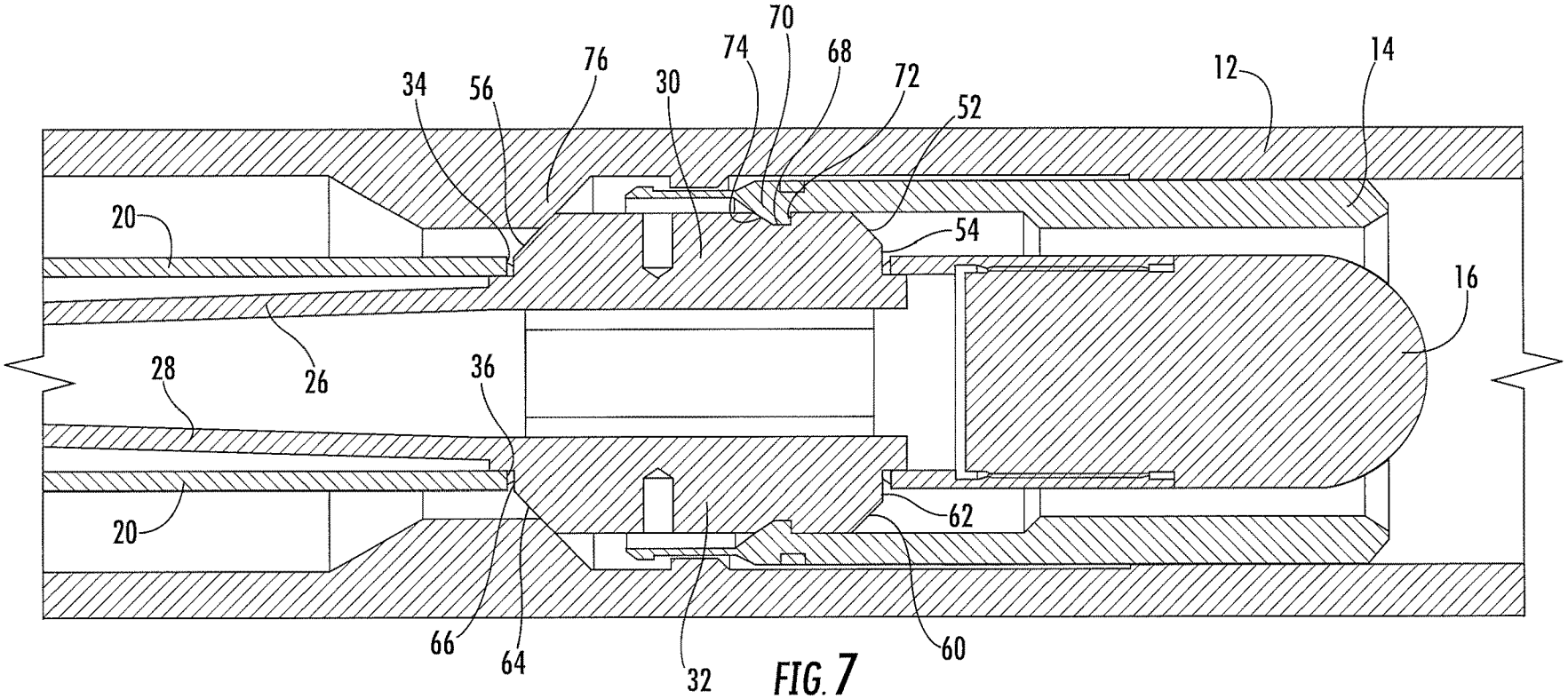
FIG. 7 is a close-up cross-sectional view of a portion of the downhole tool shown in FIG. 2 interacting with a sleeve and constructed in accordance with the present disclosure.

The present disclosure relates to a sleeve shifting tool 10 that can be run into a downhole tool 12 that includes a shiftable sleeve 14 (see FIG. 7). The sleeve shifting tool 10 can be designed to shift the shiftable sleeve 14 in an uphole direction or a downhole direction in a wellbore.

Figure 1:
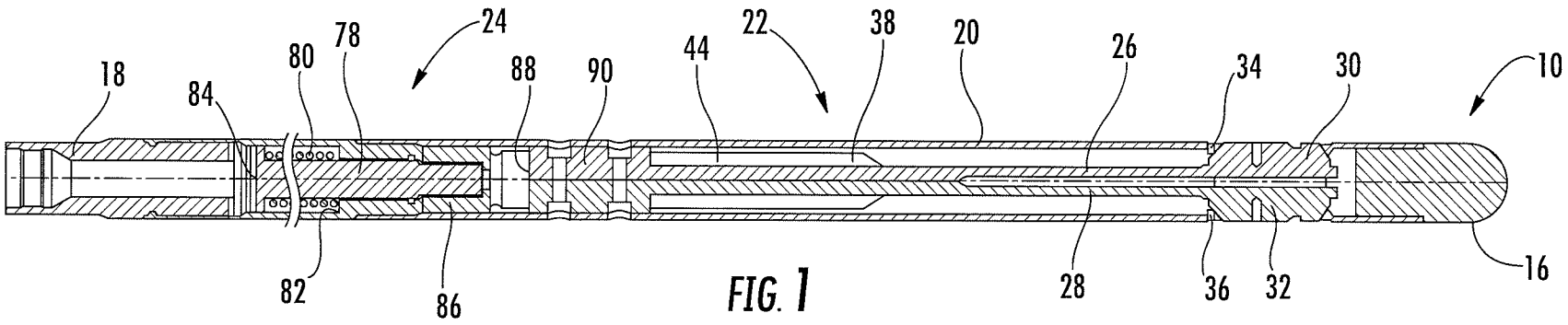
FIG. 1 is a cross-sectional view of a downhole tool in a first position constructed in accordance with the present disclosure.
Figure 2:
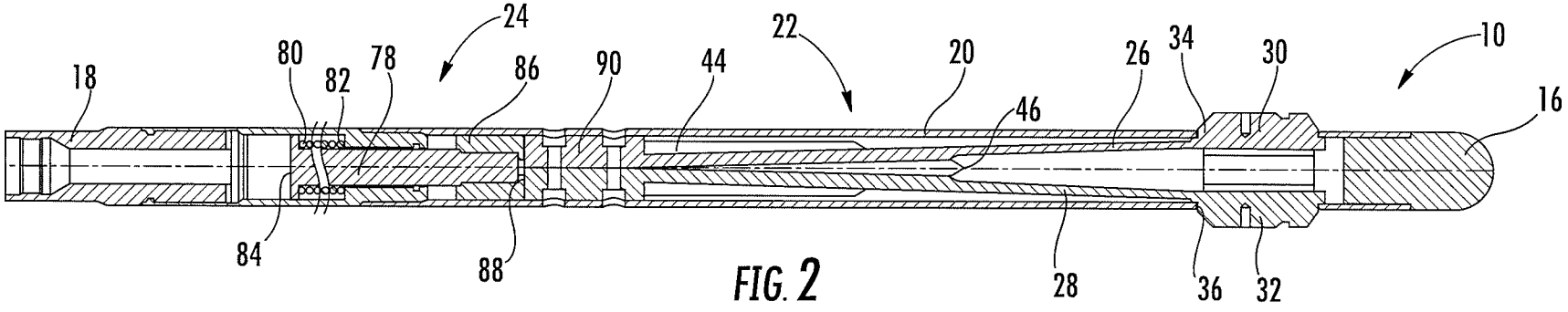
FIG. 2 is a cross-sectional view of the downhole tool in a second position constructed in accordance with the present disclosure.
Figure 3:
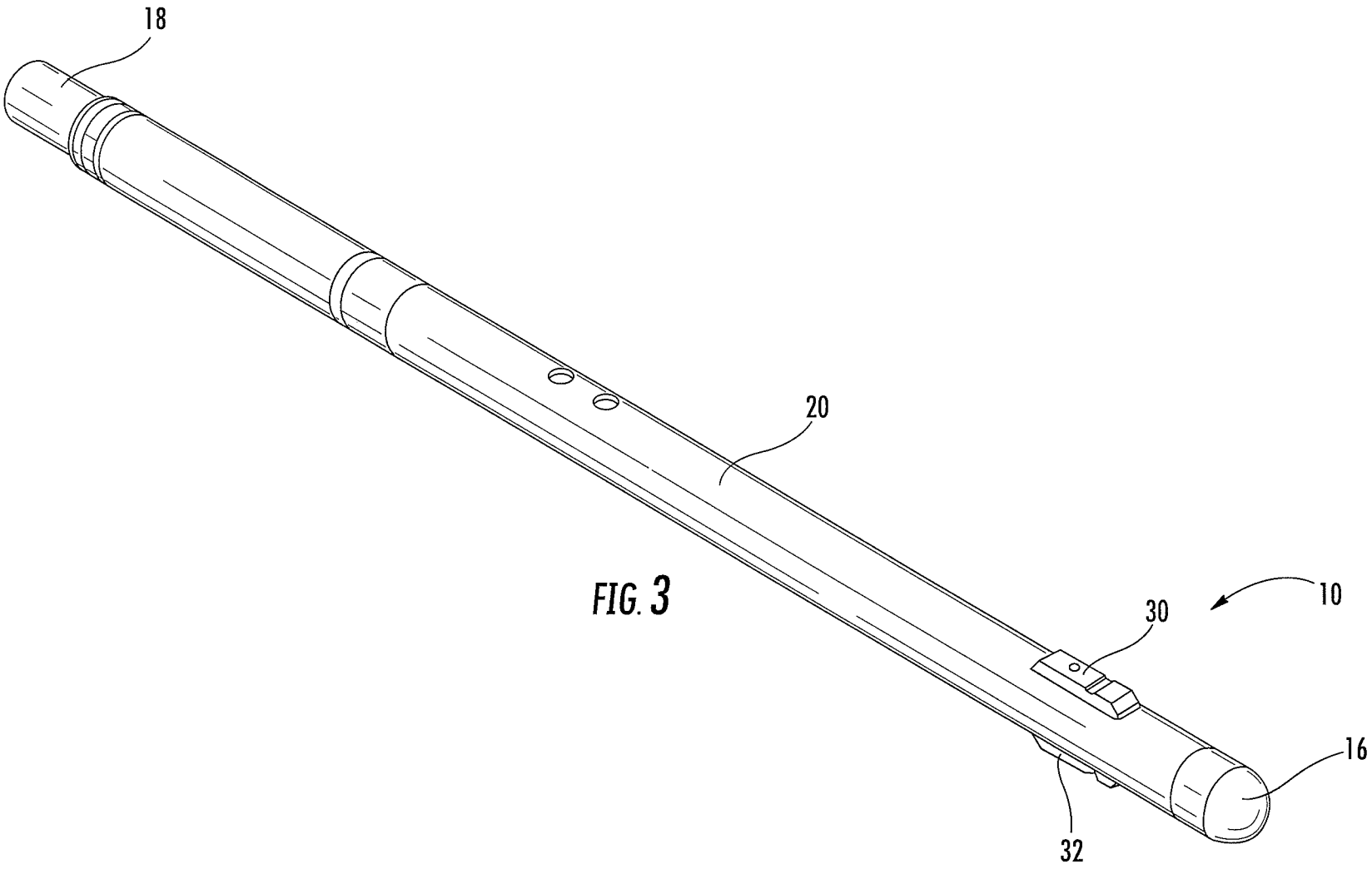
FIG. 3 is a perspective view of the downhole tool in the second position constructed in accordance with the present disclosure.

Referring now to the drawings, and more particularly FIGS. 1-3, the sleeve shifting tool 10 includes a lead end 16 disposed on a downhole end of the sleeve shifting tool 10, a connection end 18 for connecting the sleeve shifting tool 10 to a bottom hole assembly (BHA), drill string, coiled tubing, or the like, a housing 20 extending from the lead end 16 to the connection end 18, a collet apparatus 22 for engaging with the shiftable sleeve 14 (shown in FIG. 7) to slide in a predetermined direction, and a collet activation apparatus 24 to cause the collet apparatus 22 to be engagable with the shiftable sleeve 14.

The lead end 16 of the sleeve shifting tool 10 is sized and shaped such that it can easily pass through various downhole tools so that it can reach the shiftable sleeve 14. In one embodiment, the lead end 16 of the sleeve shifting tool 10 can be rounded to increase the efficiency at which the sleeve shifting tool 10 can move through various downhole tools. The connection end 18 of the sleeve shifting tool 10 can be designed such that it is attachable to any device required to facilitate the movement of the sleeve shifting tool 10 uphole and downhole in the wellbore.

The collet apparatus 22 includes a first collet arm 26 and a second collet arm 28 having a first collet key 30 and a second collet key 32 disposed on one end of each collet arm 26, 28, respectively. Each collet arm 26, 28 provides flexibility so that each collet key 30, 32 can move more easily in the radial direction. The housing 20 includes a first opening 34 corresponding to the first collet key 30 and a second opening 36 corresponding to the second collet key 32 to permit each collet key 30, 32 to extend therethrough and engage the shiftable sleeve 14.

The length and shape of the first collet arm 26 and the second collet arm 28 can vary depending on the flexibility desired for the first collet arm 26 and the second collet arm 28. Similarly, the material of construction of the first collet arm 26 and the second collet arm 28 can be selected based on the desired flexibility of the first collet arm 26 and the second collet arm 28.

Figure 4:
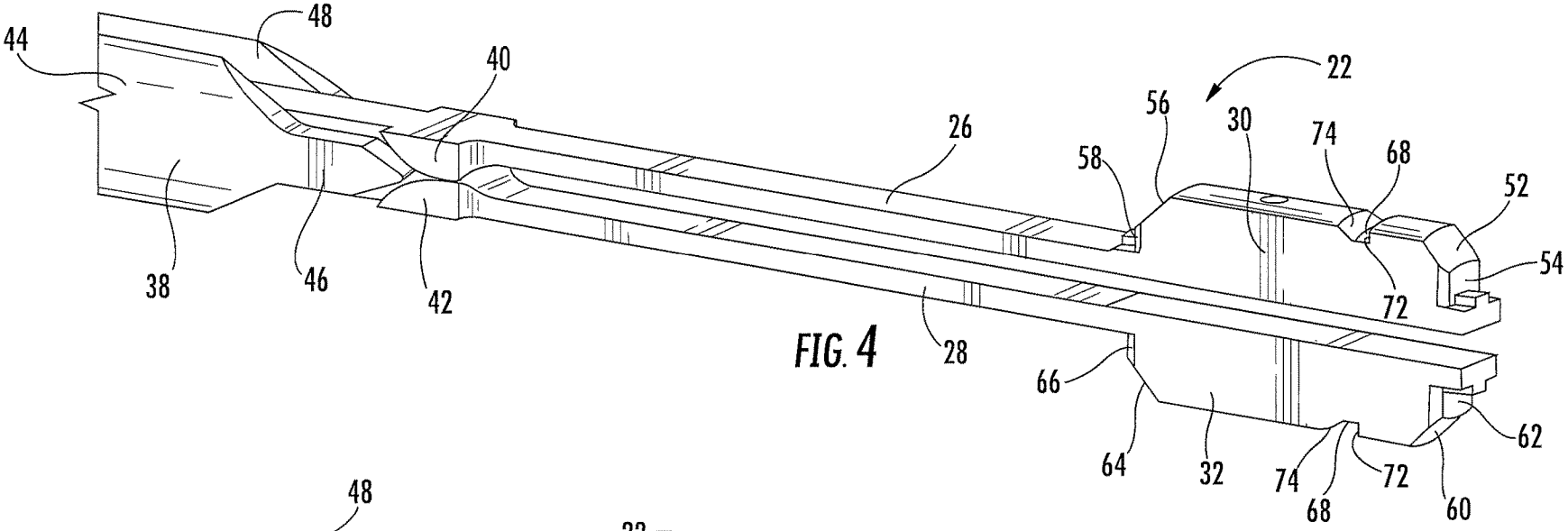
FIG. 4 is an isolated perspective view of a portion of the downhole tool in a first position and constructed in accordance with the present disclosure.
Figure 5:
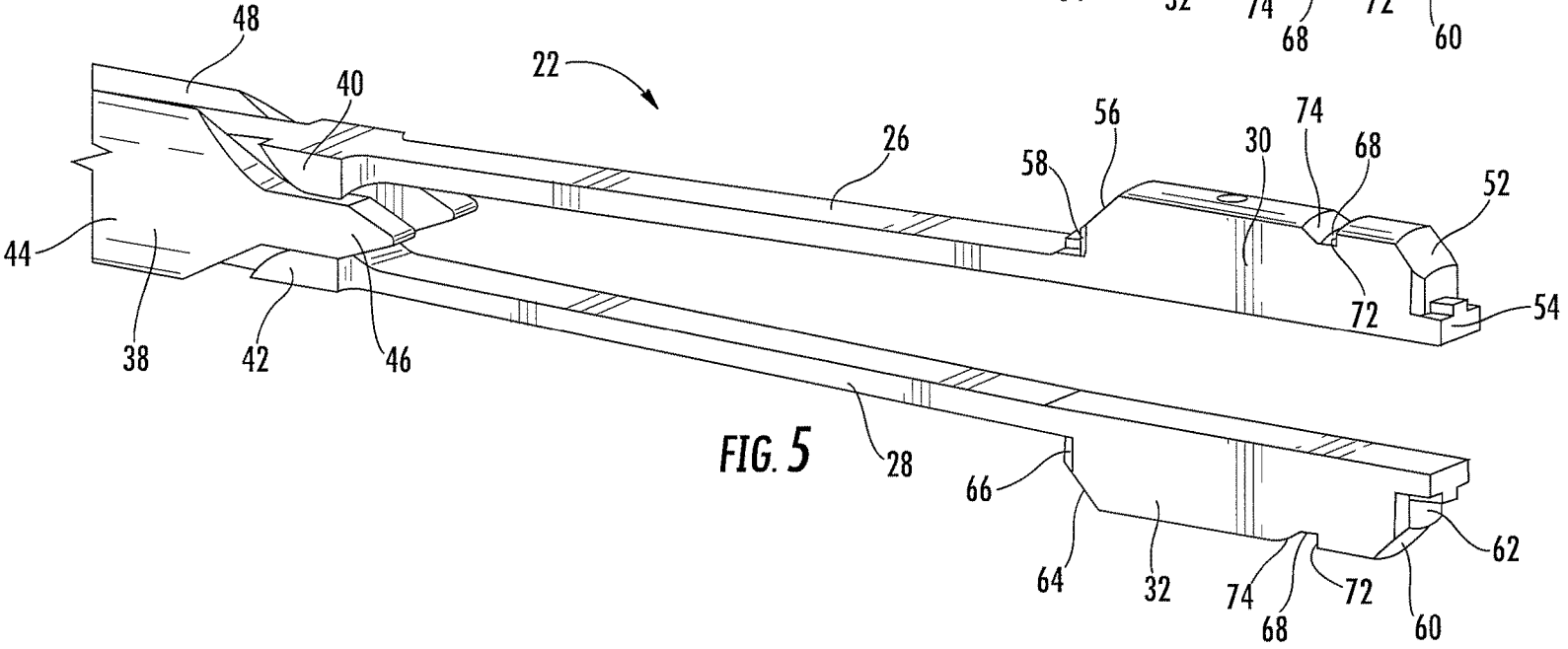
FIG. 5 is an isolated perspective view of the portion of the downhole tool in a second position and constructed in accordance with the present disclosure.

Referring now to FIGS. 4 and 5, the collet apparatus 22 can also include a collet prop 38 slidably disposed within the housing 20 to engage a first lug 40 disposed on the first collet arm 26 a predetermined distance from the first collet key 30. Similarly, the collet prop 38 engages a second lug 42 disposed on the second collet arm 28 a predetermined distance from the second collet key 32. When the collet prop 38 is forced between the lugs 40 and 42, the first collet arm 26 and the second collet arm 28 are forced away from each other, the first collet key 30 is forced out of the first opening 34 in the housing 20 to engage the shiftable sleeve 14 and the second collet key 32 is forced out of the second opening 36 in the housing 20 to engage the shiftable sleeve 14. In one embodiment, the lugs 40 and 42 extend from the sides of the first and second collet arms 26, 28 to allow for a larger expansion ratio of the collet arms 26 and 28, and thus, the collet keys 30, 32.

In one embodiment, the lugs 40 and 42 are disposed on the collet arm 26, 28 a sufficient distance from the collet keys 30, 32 so that when a sufficient inward, radial directed force is applied to the collet keys 30, 32, the collet arms 26, 28 flex and the collet keys 30, 32 extend inward and disengage from the sleeve 14 without having to disengage the collet prop 38. In further embodiments, the lugs 40 and 42 can be greater than about one (1) inch from the collet keys 30, 32; greater than about five (5) inches from the collet keys 30, 32; greater than about ten (10) inches from the collet keys 30, 32; and greater than about twenty (20) inches from the collet keys 30, 32.

The collet prop 38 can include a prop body 44 and an engaging end 46 disposed on one end of the prop body 44 to interact with the lugs 40, 42 disposed on the collet arms 26, 28. In one embodiment, the prop body 44 includes a first channel 48 for receiving a portion of the first collet arm 26 to maintain the alignment of the first collet arm 26 in the housing 20 of the sleeve shifting tool 10. Similarly, the prop body 44 can include a second channel (not visible in FIGS. but clear where the second channel is) for receiving a portion of the second collet arm 28 to maintain the alignment of the second collet arm 26 in the housing 20 of the sleeve shifting tool 10.

The engaging end 46 of the collet prop 38 can have an angled or arced shape so as to ease the engaging end's 46 ability to be forced between the lugs 40, 42, which forces the collet arms 26, 28 and the collet keys 30, 32 away from each other. The height of the engaging end 46 increases as you travel in the uphole direction of the sleeve shifting tool 10. In another embodiment, the first lug 40 and the second lug 42 can have an angled or arced shape to further the ease with which the engaging end 46 of the collet prop 38 can slide between the lugs 40, 42. Conversely, the height of the lugs 40, 42 increases as you move in the downhole direction of the sleeve shifting tool.

Figure 6A:
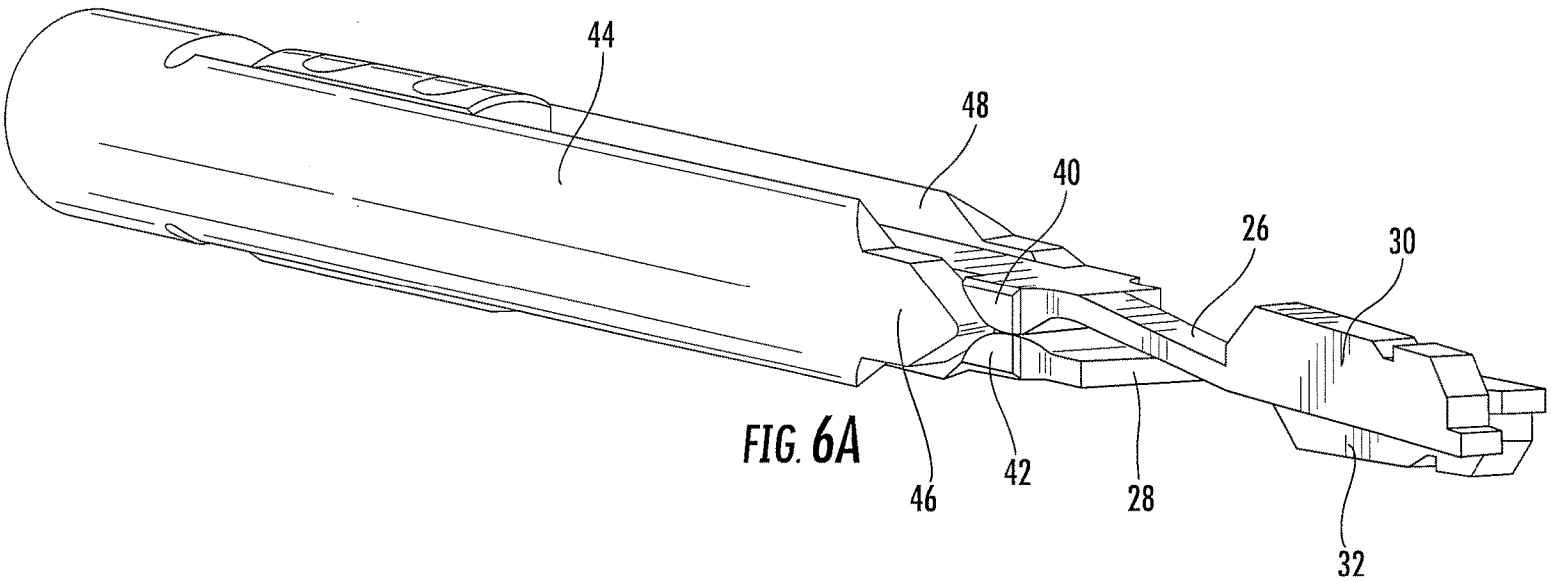
FIG. 6A is an isolated perspective view of another embodiment of the portion of the downhole tool in a first position and constructed in accordance with the present disclosure.
Figure 6B:
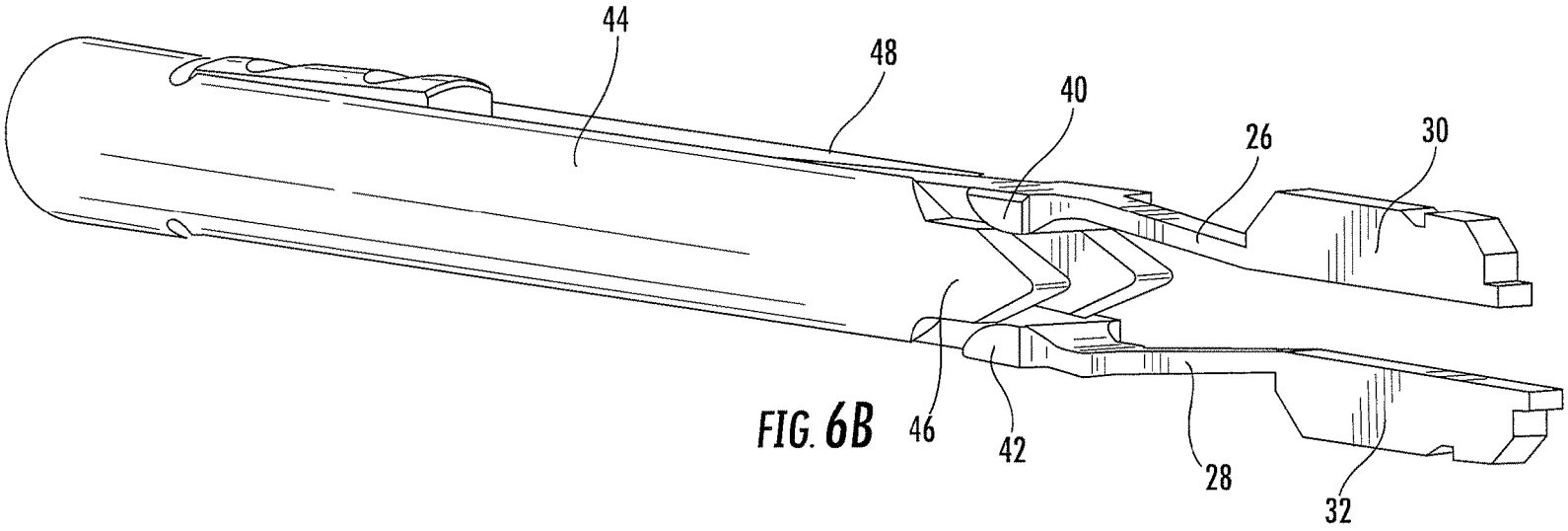
FIG. 6B is an isolated perspective view of the portion of the downhole tool shown in FIG. 6A in a second position and constructed in accordance with the present disclosure.

Each collet arm 26, 28 in this embodiment can extend inward in the radial direction essentially to a centerline of the sleeve shifting tool 10. In most operable scenarios, the first or second collet arm 26 or 28 will extend inward and not extend past the centerline due to the other collet arm 26 or 28 being forced inward opposite the first or second collet arm 26 or 28. In another embodiment shown in FIGS. 6A and 6B, the first collet arm 26 can be offset from the second collet arm 28 inside the housing 20. The collet arms 26 or 28 being offset would permit each collet arm 26 or 28, and thus collet keys 30 or 32, to extend inward beyond the centerline for the sleeve shifting tool 10.

The first collet key 30 can have a first angled portion 52 disposed on a leading end 54 of the first collet key 30 to facilitate movement of the sleeve shifting tool 10 in the downhole direction and a second angled portion 56 disposed on a trailing end 58 of the first collet key 30 to facilitate movement of the sleeve shifting tool 10 in the uphole direction. Similarly, the second collet key 32 can have a first angled portion 60 disposed on a leading end 62 of the second collet key 32 to facilitate movement of the sleeve shifting tool 10 in the downhole direction and a second angled portion 64 disposed on a trailing end 66 of the second collet key 32 to facilitate movement of the sleeve shifting tool 10 in the uphole direction.

Each collet key 30, 32 can also include a key slot 68 to engage a profile 70 disposed on an inner portion of the sleeve 14. The key slot 68 can include a shoulder 72 and an angled portion 74 to interact with the profile 70 specific to the shiftable sleeve 14. The orientation of the angled portion 74 of the key slot 68 and the shoulder 72 vary, depending on the particular profile 72 of the shiftable sleeve 14 the sleeve shifting tool 10 is interacting with, and the particular direction the sleeve shifting tool 10 is shifting the shiftable sleeve 14. Furthermore, the shoulder 72 is not limited to an orientation where the shoulder 72 is exactly perpendicular to the collet key 30 (or axis of the tool 10). In one embodiment, the shoulder 72 can be slightly angled so that the collet keys 30, 32 remain engaged but increases the difficulty of the keys 30, 32 to automatically release until the shoulder 76 is encountered. In a further embodiment, the angle of the shoulder 72 from the collet keys 30, 32 (or the axis of the tool 10) is about 95°.

FIG. 7 shows a shiftable sleeve 14 that would be required to be shifted in the uphole direction. Thus, the shoulder 72 is disposed downhole of the angled portion 74 of the key slot 68. The shoulder 72 and the angled portion 74 of the slot key 68 on the collet key 30, 32 will release the shiftable sleeve 14 when a restriction 76 disposed in the shiftable sleeve 14 is reached when the shiftable sleeve 14 has been slid to the end of its shifting position. The restriction 76 is able to force the collet key 30, 32 back into the housing 20 due to the flexion in the collet arms 26, 28. It should be understood and appreciated that if the shiftable sleeve 14 is required to be moved in the downhole direction, the shoulder 72 would be disposed in the key slot 68 uphole of the angled portion 74 of the key slot 68.

Referring again to FIGS. 1 and 2, the collet activation apparatus 24 includes a plunger 78 slidably disposed within the housing 20 and a return spring 80 disposed between a shoulder 82 and a portion of the plunger 78 to return the plunger 78 from a second position to a first position. The return spring 80 also acts to maintain the plunger 78 in the first position when fluid pressure above the plunger 78 is below a specific amount. The plunger 78 includes a pressure surface 84 and a piston head 86 for engaging a back portion 88 of the prop body 44. The pressure surface 84 receives the pressured up fluid from the surface to force the plunger 78 from the first position, in the downhole direction and toward its second position. The piston head 86 engages the back portion 88 of the prop body 44 to force the engaging end 46 of the collet prop 38 between the lugs 40, 42 disposed on the collet arms 26, 28. The plunger 78 and piston head 86 are prevented from traveling too far in the downhole direction by a collet arm body 90 disposed in the housing 20. The first collet arm 26 and the second collet arm 28 extend from the collet arm body 90.

The sleeve shifting tool 10 has a first position shown in FIGS. 1, 4 and/or 6A, or run-in-hole (RIH) position and a second position shown in FIGS. 2-3, 5 and/or 6B. In the first position, the plunger 78 and piston head 86 are in a first position and they are not forcing the collet prop 38 to engage the lugs 40, 42 disposed on the collet arms 26, 28. Thus, the collet keys 30, 32 are primarily disposed in the housing 20 and not forced outward through the openings 34, 36 disposed in the housing 20.

In the second position, the pressured fluid from the surface contacts the pressure surface 84 of the plunger 78 and forces the plunger 78 and piston head 86 in a downhole direction in the housing 20, which forces the engaging end 46 of the collet prop 38 between the lugs 40, 42 disposed on the collet arms 26, 28. This forces the first collet arm 26 to travel away from the second collet arm 28. Consequently, the first collet key 30 disposed on the first collet arm 26 is forced outward through the opening 34 in the housing 20 to ultimately engage the shiftable sleeve 14 when the sleeve shifting tool 10 reaches a particular location responsive to the shiftable sleeve 14. Similarly, the second collet key 32 disposed on the second collet arm 28 is forced outward through the opening 36 in the housing 20 to ultimately engage the shiftable sleeve 14 when the sleeve shifting tool 10 reaches a particular location responsive to the shiftable sleeve 14.

The collet keys 30, 32 positioned on the collet arms 26, 28 allow the collet keys 30, 32 to more easily be forced inward when the collet keys 30, 32 encounter restrictions as it travels because the collet arms 26, 28 allow for some flexion. Damage to the collet keys 30, 32 is also limited by the flexion of the collet arms 26, 28, allowing the collet keys 30, 32 to bend inward when restrictions are encountered.

Pressure can be relieved from the pressure surface 84 of the plunger 78 and the return spring 80 will push the plunger 78 back into the first position, which will cause the collet prop 38 to retract from between the lugs 40, 42 disposed on the collet arms 26, 28. The collet keys 30, 32 will then be permitted to extend inward through the openings 34, 36 in the housing 20. This would allow the sleeve shifting tool 10 to disengage from the shiftable sleeve 14 and be retracted from within any downhole tool it was disposed in and be pulled back to the surface.

From the above description, it is clear that the present disclosure is well adapted to carry out the objectives and to attain the advantages mentioned herein as well as those inherent in the disclosure. While presently disclosed embodiments have been described for purposes of this disclosure, it will be understood that numerous changes may be made which will readily suggest themselves to those skilled in the art and which are accomplished within the spirit of the disclosure.

What is claimed is:

1. A sleeve shifting tool, the tool comprising:

a housing;

a collet apparatus for engaging a slidable sleeve disposed within a downhole tool positioned in a wellbore, the collet apparatus comprising:

a first collet arm and a second collet arm, each collet arm having a collet key disposed thereon for engaging the slidable sleeve;

openings disposed in the housing for permitting each collet key to extend therethrough and engage the slidable sleeve; and a collet prop disposed entirely within the housing during all operational uses of the sleeve shifting tool, the collet prop engages the first and second collet arms to force them away from each other; the collet prop comprising:

a leading end to engage lugs disposed on the collet arms to force the collet arms in opposite directions, the lugs disposed on the first collet arm and the second collet arm are disposed on the collet arms and spaced apart from the collet keys in the axial direction such that the collet arms can flex when inward, radial directed force is applied to the collet keys;

a prop body;

a first channel disposed in the prop body for receiving a portion of the first collet arm; and a second channel disposed in the prop body for receiving a portion of the second collet arm; and a collet activation apparatus for initiating the collet apparatus and forcing the collet keys of the collet apparatus to engage the slidable sleeve.

2. The tool of claim 1 wherein the lugs extend from at least one side portion of each of the collet arms.

3. The tool of claim 2 wherein each lug extends from both sides of each collet arm.

4. The tool of claim 1 wherein the leading end has an arced or angled shape.

5. The tool of claim 1 wherein the lugs have an arced or angled shape.

6. The tool of claim 1 wherein the collet activation apparatus includes a plunger slidably disposed in the housing that can be forced to engage the prop body to force the collet keys disposed on the collet arms outward to engage the slidable sleeve, the plunger slides in the housing when fluid above a certain pressure is applied to the plunger.

7. The tool of claim 1 wherein the collet key includes a key leading end, a trailing end and a key slot to fit a profile on the slidable sleeve.

8. The tool of claim 7 wherein the key leading end and the trailing end of the collet key has an angled portion.

9. The tool of claim 7 wherein the key slot includes a shoulder and an angled portion to match the profile of the slidable sleeve.

10. The tool of claim 1 wherein the first and second collet arms are offset so that each arm can extend into the housing past a centerline in the housing.

11. The apparatus of claim 1 wherein the first and second collet arm having open space disposed therebetween to allow the first and second collet arms to flex inward when running the sleeve shifting tool through the downhole tool prior to engaging the slidable sleeve.

12. The apparatus of claim 1 wherein the first channel and the second channel are axially directed and each channel having sides that run axially.

13. A method for shifting a sleeve in a downhole tool, the method comprising:

positioning a sleeve shifting tool at a desired location within a downhole tool having a slidable sleeve disposed therein, the sleeve shifting tool comprising:

a housing;

a collet apparatus for engaging the slidable sleeve disposed within the downhole tool positioned in a wellbore, the collet apparatus comprising:

a first collet arm and a second collet arm, each collet arm having a collet key disposed thereon for engaging the slidable sleeve;

openings disposed in the housing for permitting each collet key to extend therethrough and engage the slidable sleeve; and a collet prop disposed entirely within the housing during all operational uses of the sleeve shifting tool, the collet prop engages the first and second collet arms to force them away from each other; the collet prop comprising:

a leading end to engage the lugs on the collet arms to more easily force the collet arms in opposite directions, the lugs disposed on the first collet arm and the second collet arm are disposed on the collet arms and spaced apart from the collet keys in the axial direction such that the collet arms can flex when inward, radial directed force is applied to the collet keys;

a prop body;

a first channel disposed in the prop body for receiving a portion of the first collet arm; and a second channel disposed in the prop body for receiving a portion of the second collet arm; and a collet activation apparatus for initiating the collet apparatus and forcing the collet keys of the collet apparatus to engage the slidable sleeve; and shifting the shiftable sleeve in the downhole tool in an uphole direction or a downhole direction.

14. The method of claim 13 wherein the leading end has an arced or angled shape.

15. The method of claim 14 wherein the collet activation apparatus includes a plunger slidably disposed in the housing that can be forced to engage the prop body to force the collet keys disposed on the collet arms outward to engage the slidable sleeve, the plunger slides in the housing when fluid above a certain pressure is applied to the plunger.

16. The method of claim 13 wherein the lugs have an arced or angled shape.

17. The method of claim 13 wherein the collet key includes a key leading end, a trailing end and a key slot to fit a profile on the slidable sleeve.

18. The method of claim 17 wherein the key leading end and the trailing end of the collet key has an angled portion.

19. The method of claim 18 wherein the key slot includes a shoulder and an angled portion to match the profile of the slidable sleeve.

20. The method of claim 13 further comprising releasing the collet key from the shiftable sleeve and withdrawing the sleeve shifting tool from the downhole tool.

21. The method of claim 13 wherein the first and second collet arms are offset so that each arm can extend into the housing past a centerline in the housing.

22. The method of claim 13 where in the lugs extend from at least one side portion of the collet arms.

23. The method of claim 13 wherein each lug extends from both sides of each collet arm.

24. The method of claim 13 wherein the first and second collet arm having open space disposed therebetween to allow the first and second collet arms to flex inward when running the sleeve shifting tool through the downhole tool prior to engaging the slidable sleeve.

25. The method of claim 13 wherein the first channel and the second channel are axially directed and each channel having sides that run axially.

* * * * *